US005086538A

United States Patent [19]

Zahuranec

[11] Patent Number: 5,086,538

[45] Date of Patent: Feb. 11, 1992

[54] INCREMENTAL FOOT OPERATED HEIGHT ADJUSTER FOR UPRIGHT VACUUM CLEANER

[75] Inventor: Terry L. Zahuranec, Hudson, Ohio

[73] Assignee: Royal Appliance Mfg. Co., Cleveland, Ohio

[21] Appl. No.: 542,450

[22] Filed: Jun. 22, 1990

[51] Int. Cl.[5] ..... A47L 5/34

[52] U.S. Cl. ..... 15/354; 280/43.24

[58] Field of Search ..... 15/354, 356; 280/43, 280/43.1, 43.24

[56] References Cited

U.S. PATENT DOCUMENTS

| | | | |
|---|---|---|---|
| 1,852,100 | 4/1932 | Ballou . | |
| 2,048,518 | 7/1936 | Ray . | |
| 2,079,293 | 5/1937 | Kirby | 15/356 |
| 2,172,911 | 9/1939 | Kirby | 15/354 |
| 2,172,973 | 9/1939 | Hays et al. . | |
| 2,214,855 | 9/1940 | Holm-Hansen | 280/43 |
| 2,221,746 | 11/1940 | Kirby . | |
| 2,823,412 | 2/1958 | Kirby | 15/354 |
| 3,722,024 | 3/1973 | Schmitz | 15/354 |
| 3,822,436 | 7/1974 | Burgoon | 15/354 |
| 3,875,605 | 4/1975 | Fegan | 15/356 |
| 3,909,874 | 10/1975 | Clowers et al. | 15/339 |
| 4,078,275 | 3/1978 | Baird | 15/354 |
| 4,513,472 | 4/1985 | Wells | 15/354 |
| 4,955,103 | 9/1990 | Scott et al. | 15/354 |

FOREIGN PATENT DOCUMENTS

| | | | |
|---|---|---|---|
| 610147 | 10/1948 | United Kingdom | 15/354 |

*Primary Examiner*—Edward L. Roberts
*Assistant Examiner*—Mark Spisich
*Attorney, Agent, or Firm*—Fay, Sharpe, Beall, Fagan, Minnich & McKee

[57] ABSTRACT

A foot operated nozzle height adjusting mechanism for a vacuum cleaner of the type characterized by a housing having a front cleaning nozzle that is pivotable about a pair of front wheels through the change in height of a pair of rear wheels that are secured in a wheel fork pivotally mounted on the housing includes first and second pedals. The first pedal is secured to the wheel fork. The second pedal is provided on a member that is pivotally secured to the housing and includes an adjustment lever extending in a direction substantially normal to the wheel fork. The adjustment lever includes a plurality of spaced teeth. A locking plate is secured to the wheel fork and the spaced teeth of the adjustment lever are adapted to selectively engage the locking plate. A biasing element urges the adjustment lever teeth against the locking plate.

20 Claims, 3 Drawing Sheets

INCREMENTAL FOOT OPERATED HEIGHT ADJUSTER FOR UPRIGHT VACUUM CLEANER

BACKGROUND OF THE INVENTION

This invention relates to appliances used for floor cleaning and the like. More specifically, the present invention relates to a means for adjusting the disposition of a vacuum cleaner carriage relative to a floor surface.

Vacuum cleaners of the floor cleaning or upright type generally include a chassis having a nozzle on a lower surface of a front end thereof through which air is sucked by an air moving motor-blower unit. A rotary brush is mounted adjacent the nozzle for contacting the floor surface to agitate and loosen dirt so that it may be sucked free of the surface. Wheels or other supports are rotatably mounted at the front and rear of the chassis for supporting the cleaner in a rolling manner on the floor. These vacuum cleaners are called upon to clean many different kinds of modern floor coverings varying in pile thickness from the short outdoor or patio-type carpeting to the long deep shag-type.

In order to clean these various floor surfaces effectively, it is known to vary the vacuum cleaner's nozzle height in order to locate the nozzle at a proper level above the surface to provide the required suction for the particular type of floor covering or surface being cleaned and to position the brush at the proper height. While many types of nozzle height adjusting mechanisms are known to the art, the known mechanisms are relatively complex and include a large number of parts because many nozzle heights are necessary to handle the different kinds of modern floor coverings available. The inherent multiplicity of such parts has made it more expensive to manufacture and assemble an upright vacuum cleaner.

One of the most common models of vacuum cleaners has a somewhat T-shaped housing which is supported on a widely spaced set of front wheels and a narrowly spaced set of rear wheels. The rear wheels are mounted on a carrier fork that extends rearward from a transverse horizontal pivot shaft. A height adjustment for this type of vacuum cleaner can be obtained through the use of a screw which is provided through a hole in the rear end of the rear housing and engages a cross brace on the rear wheel carrier fork. By manually turning the screw in one direction, the rear of the unit is lowered causing the floor cleaning nozzle to pivot about the front wheels in a downward direction. Turning the screw in the opposite direction allows the pivot shaft spring to raise the rear wheels and cause the floor cleaning nozzle to rise. When the manual turning of the screw produces the desired nozzle position, the rotation of the screw can be stopped.

Unfortunately, this type of height adjustment mechanism is time consuming to use and requires that the operator kneel down each time an adjustment needs to be made to the vacuum cleaner's height. Also, constant use of such a height adjustment mechanism, such as when the vacuum cleaner is used in an institutional setting, for example in a hospital, hotel or office building, will lead to the breakage of this conventional height adjustment mechanism.

Another problem with this known type of vacuum cleaner is that the rear wheel carrier fork sometimes jams against the underside of the vacuum cleaner housing beyond the maximum height adjustment position. This occurs most frequently when the vacuum cleaner is being pulled backwards and the rear wheels strike a raised section of the floor surface, such as the edge of a carpet. Although a pivot spring is provided to bias the carrier fork and prevent such doubling under, the spring often weakens with age or breaks thereby allowing this type of action to occur.

Accordingly, it has been considered desirable to develop a new and improved vacuum cleaner height adjusting mechanism which is mechanically simple, compact, durable in nature and which overcomes the foregoing difficulties and others while providing better and more advantageous results.

BRIEF SUMMARY OF THE INVENTION

In accordance with the present invention, a foot operated nozzle height adjusting mechanism is provided for a vacuum cleaner of the type characterized by a housing having a front cleaning nozzle that is pivotable about a pair of front wheels through the change in height of a pair of rear wheels that are secured in a wheel fork that is pivotally mounted on the housing.

More particularly in accordance with the invention, the height adjusting mechanism comprises a first pedal secured to the wheel fork and a second pedal pivotally secured to the housing and including an adjustment lever extending in a direction substantially normal to the wheel fork. The adjustment lever includes a plurality of spaced teeth. A locking plate is secured to the wheel fork wherein the spaced teeth of the adjustment lever are adapted to selectively engage the locking plate. A means for biasing the adjustment lever teeth against the locking plate is also provided.

In accordance with another aspect of the present invention, a vacuum cleaner is provided.

More particularly in accordance with this aspect of the invention, the vacuum cleaner comprises a carriage including front and rear support means rotatably carried by the carriage for movably supporting the carriage on a subjacent surface. A floor cleaning nozzle is generally horizontally disposed adjacent the front support means of the vacuum cleaner. A first pedal, secured to the rear support means, is provided for adjusting the height of the nozzle in relation to the subjacent surface. A second pedal which is rotatably secured to the carriage is provided for holding a height selected by the first pedal. The second pedal comprises a foot contact portion, a pivot portion at which the second pedal is secured to the carriage and a lever portion provided with a plurality of spaced teeth. A means for resiliently biasing the second pedal in a first direction in relation to the carriage is also provided.

In accordance with still another aspect of the present invention, a nozzle height adjusting mechanism is provided for a vacuum cleaner having a carriage with a front floor cleaning nozzle that is pivotable about a pair of front wheels through the change in height of a rear end of the carriage.

More particularly in accordance with this aspect of the invention, the mechanism comprises a wheel fork for holding a pair of rear wheels mounted on an axle. The rear wheels rotatably support the rear end of the carriage. The fork comprises a front end which is pivotally secured to the carriage, a locking plate portion, a center portion to which the axle can be secured and a pedal portion. A second pedal is pivotally secured to the housing and includes an adjustment lever extending in a direction substantially normal to the wheel fork.

The adjustment lever includes a plurality of spaced teeth wherein the spaced teeth of the adjustment lever are adapted to selectively engage the wheel fork locking plate portion. Also provided is a means for biasing the adjustment lever teeth against the locking plate portion.

One advantage of the present invention is the provision of a new and improved appliance height adjustment mechanism.

Another advantage of the present invention is the provision of a vacuum cleaner nozzle height adjustment mechanism that is simple and economical in construction while yet providing a rugged and durable device.

Still another advantage of the present invention is the provision of a vacuum cleaner nozzle height adjustment mechanism which can be readily adjusted for different pile heights without the operator having to kneel down to make the adjustments.

Yet another advantage of the present invention is the provision of a vacuum cleaner nozzle height adjustment mechanism which is controlled through a pair of spaced pedals.

Still yet another advantage of the present invention is a vacuum cleaner nozzle height adjustment mechanism in which a first pedal is utilized to decrease the nozzle height of the vacuum cleaner in a stepped manner and a second pedal is utilized to return the vacuum cleaner's nozzle height to a maximum position.

A further advantage of the present invention is the provision of a vacuum cleaner nozzle height adjustment mechanism which includes a resilient biasing means for holding the nozzle height at a set position.

Still other benefits and advantages of the invention will become apparent to those skilled in the art upon a reading and understanding of the following detailed specification.

BRIEF DESCRIPTION OF THE DRAWINGS

The invention may take physical form in certain parts and arrangements of parts, a preferred embodiment of which will be described in detail in this specification and illustrated in the accompanying drawings which form a part hereof, and wherein.

DETAILED DESCRIPTION OF THE PREFERRED EMBODIMENT

Figure 1:
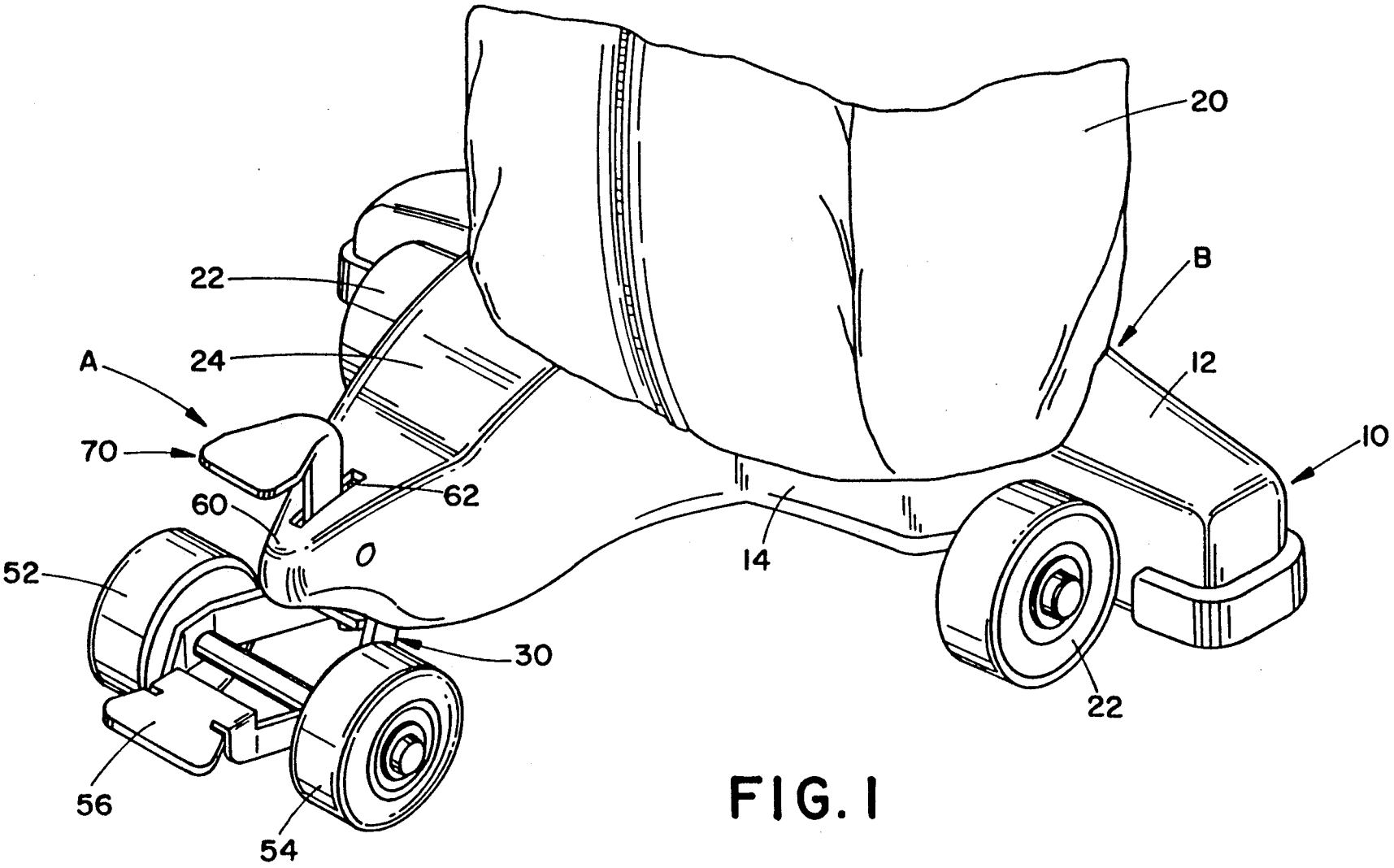
FIG. 1 is a perspective view of a rear end of a vacuum cleaner having a height adjustment mechanism according to the preferred embodiment of the present invention.

Referring now to the drawings, wherein the showings are for purposes of illustrating a preferred embodiment of the invention only and not for purposes of limiting same, FIG. 1 shows the preferred embodiment of the subject new appliance height adjusting mechanism A. While the mechanism is primarily designed for and will hereinafter be described for use with an upright vacuum cleaner B, it should be appreciated that the overall inventive concept involved could be adapted for use in many other appliance environments as well.

A housing or carriage 10 of the vacuum cleaner B includes a wide front floor cleaning nozzle 12 directed downward for suction cleaning of carpets and floors. The nozzle passes dirt laden air upwardly into a central duct 14 and then into the center of a centrifugal fan (not visible). The dirt laden air is swirled at high velocity inside a centrifugal fan housing (not visible) where it is caused to exit through a side mounted exit duct (not visible) into a dirt catching bag 20. The nozzle 12 is pivotally supported on a pair of widely spaced front wheels 22. The electric motor which powers the fan is housed in a motor housing 24 that extends rearwardly from the front wheels 22. A handle (not visible) is attached to the housing 10 in order to allow a desired movement of the vacuum cleaner A.

Figure 2:
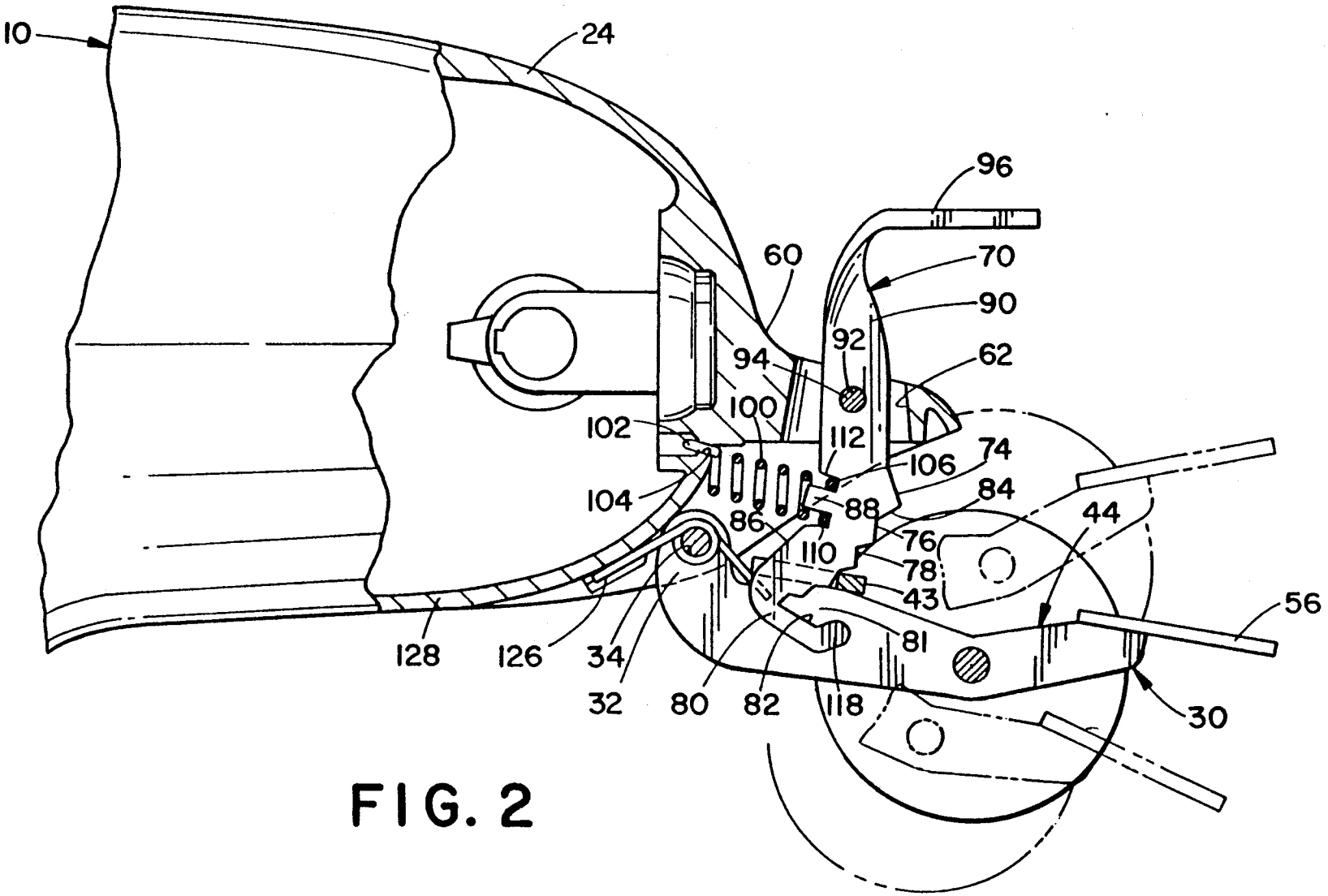
FIG. 2 is an enlarged side elevational view partially in cross-section through the nozzle height adjustment mechanism of FIG. 1; and, FIG. 3 is a top plan view of a wheel fork and axle assembly of the nozzle height adjusting mechanism of FIG. 1.
Figure 3:
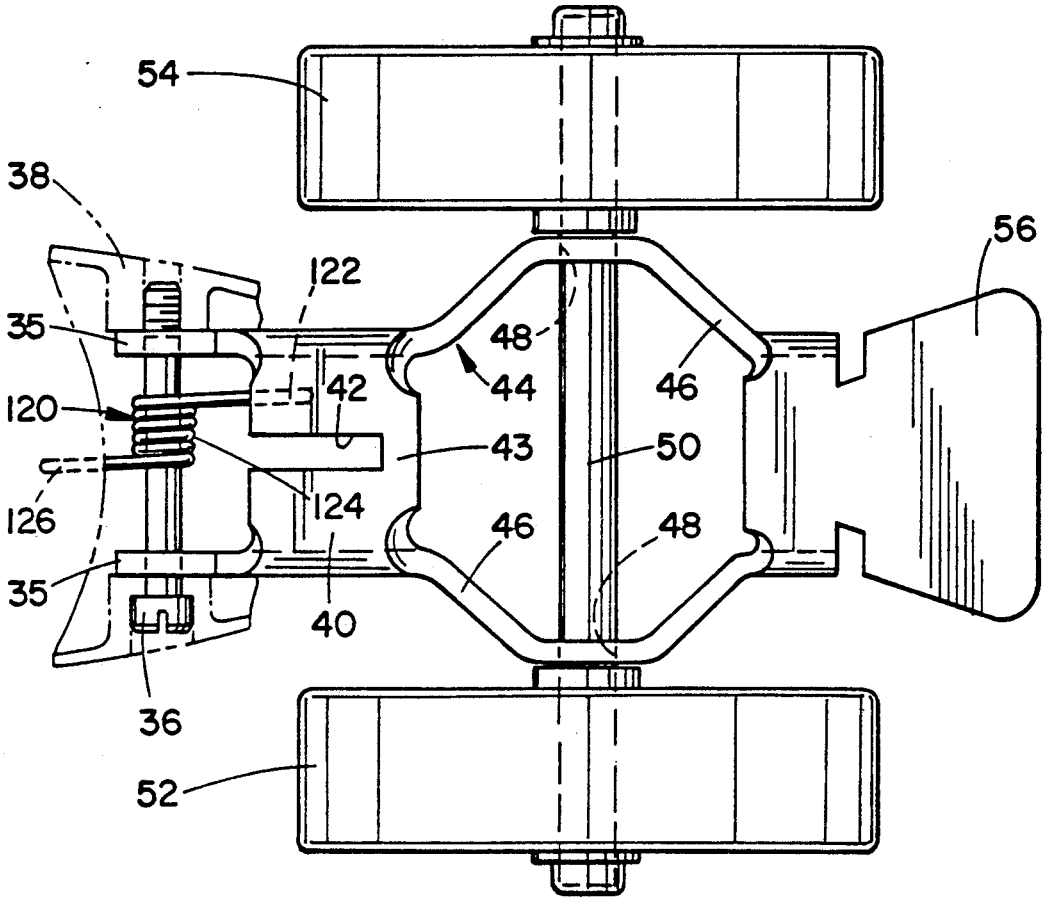

With reference now to FIG. 2, rear support is provided for the vacuum cleaner by a wheel fork 30 which includes a pivot section 32 having a through bore 34 extending therethrough. As shown in FIG. 3, the pivot section includes a pair of spaced arms 35. A fastener 36 secures the pivot section 32 to a flange 38 extending rearwardly from a lower periphery of the housing 10. Provided adjacent the pivot section 32 of the wheel fork 30 is a lock plate 40. As best shown in FIG. 3, the lock plate includes a longitudinally extending slot 42 which is substantially centrally disposed along the longitudinal axis of the wheel fork 30. At the rear of the slot is an engagement surface 43.

Provided adjacent the lock plate 40 is an axle section 44 of the wheel fork 30. The axle section includes a pair of spaced arms 46 each of which has an aperture 48 extending therethrough in a direction normal to the longitudinal axis of the wheel fork 30. The apertures allow an axle shaft 50 to be staked therethrough. A first wheel 52 is rotatably secured at one end of the axle shaft 50 while a second wheel 54 is rotatably secured at the other end of the axle shaft. In this way, the rear support for the vacuum cleaner is provided by the pair of spaced wheels 52 and 54. As shown in FIG. 1, these wheels are narrowly spaced in comparison to the front wheels 22. Extending rearwardly from the axle section 44 of the wheel fork 30 is a first pedal section 56.

Provided on a rear end of the housing 10 is a protrusion 60 through which extends a vertically running bore 62. An elongated member 70 extends through the bore 62 in a vertically oriented direction. In other words, the member 70 is substantially normal to the approximately horizontal direction of the wheel fork 30 with which the member 70 cooperates.

The member 70 includes at its lower end a lever portion 74 which has a rear face 76 that is provided with a plurality of spaced teeth 78. Preferably, five such teeth are provided allowing for five height settings for the vacuum cleaner nozzle. Located adjacent a lower most one of the teeth 78 is a flange 80 which extends back in the same plane as the teeth 78 in order to create a large slot 81. Provided for the lever portion 74 is a first stop surface 82 which defines a lower limit of the movement of the pedal 70 and a second stop surface 84 which defines an upper limit of the movement of the pedal 70.

Located on a front face 86 of the lever portion 74 is a tooth 88 which extends away from the front face 86. Located adjacent the tooth 88 is a pivot section 90 of the pedal 70. The pivot section includes an aperture 92 through which extends a fastener 94 that rotatably secures the pedal 70 in the bore 62 of the rear protrusion 60 of the housing 10.

Located above the pivot section 90 of the member 70 is a second pedal section 96. It is noted that while the lever portion 74 and pivot section 90 of the pedal member 70 extend vertically, the second pedal section 96 extends horizontally through an appropriate bend in the metal from which the pedal member 70 is preferably made.

Therefore, the second pedal section 96 lies in a plane parallel to the plane in which the first pedal section 56 is located, as best shown in FIG. 2. The two pedal members are not only spaced vertically from each other, but are also spaced horizontally such that the first pedal section is located somewhat to the rear of the second pedal section 96. In this way, unrestricted access is provided to the operator's foot for each of the pedal sections.

Resiliently biasing the member 70 in a counterclockwise direction around the rear protrusion 60 is a biasing means which can be a compression spring 100. The spring includes a front arm 102 which extends into a suitably formed slot 104 provided in the housing or carriage 10 in order to secure the spring in place. A rear end 106 of the spring extends over the tooth 88 of the pedal member 70 such that the last few coils of the spring 100 are held in suitable slots 110, 112 provided on either side of the tooth 88 in the pedal member 70.

The operation of the height adjustment mechanism is as follows. Let us assume that the vacuum cleaner nozzle 12 is at its highest position in relation to the subjacent floor surface. If it is desired to move the nozzle closer to the surface, the operator need merely to step on the first or height adjustment pedal section 56. This will move the point of engagement between the lock plate 40 and a tooth 88 of the pedal member 70 to the next lower tooth. The next lower tooth 88 will catch on the lock plate engagement surface 43 and hold there due to the resilient bias provided by the spring 100. At the next lower position, the wheel fork 30 now stands at a somewhat greater angle in relation to the longitudinal axis of the housing or carriage 10. This then will tilt the carriage forwardly about the two front wheels 22 thereby lowering the nozzle 12 in relation to the floor surface. This action can, if desired, be continued until the lowest tooth 88 of the lever portion 74 is in contact with the lock plate 40.

An upwardly angled finger 118 is provided adjacent the first stop surface 82 so as to somewhat enclose the slot 81 on the member 70. The finger 118 cooperates with a back surface of the lock plate 40 in order to prevent the wheel fork 30 from being inadvertently moved or rotated without a positive pivoting of the member 70 by the operator stepping on the pedal section 96. Such inadvertent movement may take place when the vacuum cleaner is jogged while it is being rolled between floor surfaces of different relative heights, such as from tile to carpeting or vice versa. The finger 118 also prevents the wheel fork 70 from being rotated any further counterclockwise, should the operator step on the pedal 56.

When it is desired to again select the highest setting of the vacuum cleaner's nozzle, one need merely press the release pedal or second pedal section 96. As the release pedal 96 is contacted by the operator's foot, the pedal member is rotated around the fastener 94 and pressure is exerted against the spring 100 to disengage the respective tooth 78 from the lock plate 40. Thereby the wheel fork 30 is allowed to move upwardly in relation to the rear protrusion 60 of the housing 10 to the uppermost limit provided by the second stop surface 84 which is formed by the highest tooth on the rear face 76 of the lever portion 74. Such a pivoting motion of the wheel fork 30 is caused to some extent by the weight of the carriage, and the rest of the vacuum cleaner, due to the force of gravity. Aiding the pivoting motion is a spring 120, best shown in FIG. 3, which has a first end 122 extending beneath the lock plate 40 and a central portion 124 coiled around the fastener 36. A second end 126 of the spring extends below a lower edge 128 of the motor housing 24 as shown in FIG. 2. The spring 120 exerts a counterclockwise bias on the wheel fork 30 to urge the wheel fork toward the protrusion 60.

It should be clear that a simple, inexpensive and sturdy nozzle height adjusting mechanism comprising a minimum number of parts has been disclosed in this application. While the invention has been described with reference to a preferred embodiment, obviously, modifications and alterations will occur to others upon a reading and understanding of this specification. It is intended to include all such modifications and alterations insofar as they come within the scope of the appended claims or the equivalents thereof.

I claim:

1. A foot operated nozzle height adjusting mechanism for a vacuum cleaner of the type characterized by a housing having a front floor cleaning nozzle that is pivotable about a pair of front wheels through the change in height of a rear end of the housing, the rear end including a pair of rear wheels that are secured in a wheel fork mounted by a first pivot on the housing, comprising:

a first pedal secured to said wheel fork;

a second pedal including an adjustment lever extending in a direction substantially normal to said wheel fork, said adjustment lever including a plurality of spaced teeth;

a second pivot for pivotally securing said second pedal to said housing such that said second pivot is spaced from said first pivot;

a locking plate secured to said wheel fork, wherein said spaced teeth of said adjustment lever are adapted to selectively engage said locking plate; and, a means for biasing said adjustment lever teeth against said locking plate.

2. The mechanism of claim 1 wherein said second pedal further comprises:

a first stop surface for preventing a motion of said second pedal in a first direction past a preselected first point; and, a second stop surface for preventing a motion of said second pedal in a second direction past a preselected second point.

3. The mechanism of claim 1 wherein said means for biasing comprises a first spring.

4. The mechanism of claim 3 wherein said first spring extends between said housing and said adjustment lever, and wherein said spring is a compression spring.

5. The mechanism of claim 4 further comprising:

a first means provided on said housing for holding a first end of said spring; and, a second means provided on said adjustment lever for holding a second end of said spring.

6. The mechanism of claim 1 wherein said second pedal is vertically spaced from said first pedal but is oriented in a plane parallel to a plane in which said first pedal is oriented.

7. The mechanism of claim 1 further comprising a second spring which resiliently biases said wheel fork in a counterclockwise direction.

8. The mechanism of claim 1 wherein said spaced teeth on said adjustment lever are located on a rear surface thereof.

9. A vacuum cleaner comprising:

a carriage including front and rear support means rotatably carried by said carriage for movably supporting said carriage on a subjacent surface;

a floor cleaning nozzle generally horizontally disposed adjacent said front support means of the vacuum cleaner;

a first pedal, secured to said rear support means, for adjusting the height of said nozzle in relation to the subjacent surface;

a second pedal, rotatably secured to said carriage, for holding a height selected by said first pedal, said second pedal comprising:

a foot contact portion, a pivot portion at which said second pedal is secured to said carriage, and a lever portion provided with a plurality of spaced teeth on a rear edge thereof; and, a means for resiliently biasing said second pedal in a first direction in relation to said carriage, said means contacting a front edge of said lever portion.

10. The vacuum cleaner of claim 9 wherein said second pedal further comprises:

a first stop surface for preventing a motion of said second pedal in a first direction past a preselected first point; and, a second stop surface for preventing a motion of said second pedal in a second direction past a preselected second point.

11. The vacuum cleaner of claim 9 wherein said means for biasing comprises a spring.

12. The vacuum cleaner of claim 11 wherein said spring extends between said housing and said front edge of said adjustment lever, and wherein said spring is a compression spring.

13. The vacuum cleaner of claim 12 further comprising:

a first means provided on said housing for holding a first end of said spring; and, a second means provided on said adjustment lever for holding a second end of said spring.

14. A nozzle height adjusting mechanism for a vacuum cleaner having a carriage with a front floor cleaning nozzle that is pivotable about a pair of front wheels through the change in height of a rear end of the carriage, comprising:

a wheel fork for holding a pair of rear wheels mounted on an axle, said rear wheels rotatably supporting said rear end of said carriage, said wheel fork comprising:

a front end which is pivotally secured to said carriage, a locking plate portion oriented parallel to the axle and having a vertically oriented slot extending therethrough, said locking plate portion having an engagement surface thereon, said engagement surface being oriented parallel to the axle, a center portion to which said axle is secured, and a first pedal portion;

a second pedal pivotally secured to said housing and including an adjustment lever extending in a direction substantially normal to said locking plate portion and through said slot thereof, said adjustment lever including a plurality of spaced teeth, wherein respective ones of said spaced teeth of said adjustment lever are adapted to selectively engage said wheel fork locking plate portion engagement surface; and, a means for biasing said adjustment lever teeth against said locking plate portion.

15. The mechanism of claim 14 wherein said second pedal further comprises:

a first stop surface for preventing a motion of said second pedal in a first direction past a preselected first point; and, a second stop surface for preventing a motion of said second pedal in a second direction past a preselected second point.

16. The mechanism of claim 14 wherein said means for biasing comprises a spring which extends between said carriage and said adjustment lever and wherein said spring is a compression spring.

17. The mechanism of claim 16 further comprising:

a first means provided on said carriage for holding a first end of said spring; and, a second means provided on said adjustment lever for holding a second end of said spring.

18. The mechanism of claim 14 further comprising a second spring which resiliently biases said wheel fork in a counterclockwise direction.

19. The mechanism of claim 14 wherein said plurality of teeth are located along a rear edge of said adjustment lever.

20. The mechanism of claim 14 wherein said carriage comprises a rearwardly extending projection, said adjustment lever being pivotably mounted on said projection.

* * * * *